US005160183A

United States Patent [19]

Rusyniak

[11] Patent Number: 5,160,183

[45] Date of Patent: Nov. 3, 1992

[54] COMBINATION TABLE AND LEG REST FOR RECLINING CHAIR

[76] Inventor: Michael F. Rusyniak, 9 Donald Pl., Liverpool, N.Y. 13090

[21] Appl. No.: 850,924

[22] Filed: Mar. 13, 1992

[51] Int. Cl.[5] ..... A47C 7/52; A47C 7/68

[52] U.S. Cl. ..... 297/153; 297/119; 297/423

[58] Field of Search ..... 297/68, 83–85, 297/118, 119, 148, 153, 154, 423, 438

[56] References Cited

U.S. PATENT DOCUMENTS

| | | | |
|---|---|---|---|
| D. 190,030 | 4/1961 | Beardmore . | |
| D. 193,614 | 9/1962 | Denton . | |
| D. 211,988 | 8/1968 | Cripe . | |
| D. 227,954 | 7/1973 | Gill . | |
| 684,844 | 10/1901 | Yerker | 297/119 |
| 2,403,263 | 7/1946 | Collins | 297/119 |
| 2,555,144 | 5/1951 | Londerman et al. . | |
| 2,642,122 | 6/1953 | Maurer . | |
| 2,664,942 | 1/1954 | Spear . | |
| 3,084,975 | 4/1963 | Winrow | 297/119 |
| 3,635,522 | 1/1972 | Kerwit | 297/153 |
| 4,621,863 | 11/1986 | Jackson et al. | 297/423 X |

*Primary Examiner*—Peter R. Brown
*Attorney, Agent, or Firm*—Wall and Roehrig

[57] ABSTRACT

Combination self-storing table/leg-rest for a reclining chair is shown in which a hinged table top is hooked onto a leg-rest frame member and covered with a padded upholstered cushion to match the decor of the reclining chair. Pivoted legs are mounted on the underside of the folded table and are adapted to fit into receptacles formed in the ends of the arms of the reclining chair for positioning the table in convenient position for use by a person sitting in the chair.

14 Claims, 4 Drawing Sheets

COMBINATION TABLE AND LEG REST FOR RECLINING CHAIR

BACKGROUND OF THE INVENTION

This invention relates to a table for use with a reclining chair and more particularly to a self-storing folding table and leg rest for a reclining chair.

Frequently, when seated in a chair, it is desirable to have a flat table surface available for writing or other activities by the person seated in the chair. Various table arrangements for use with chairs have been known in the prior art, such as the well-known folding arm chair in educational institutions or the typical tray table inserted in the arm rests of airline seats. Other very involved folding combination leg rest and table arrangements such as those shown in U.S. Pat. Nos. 2,403,263 and 2,555,144 have also been proposed.

All of these have had limitations, including the complexity and cost of the construction shown in the cited patents, the lack of storage space for the airline tray table type, and the poor aesthetics of the folding arm type, particularly for so called living room furniture applications.

OBJECTS AND SUMMARY OF THE INVENTION

Accordingly, it is an object of the present invention to provide an improved combination table and footrest for reclining chairs that overcomes the limitations of the prior art.

It is another object of the present invention to provide a combination table and footrest for reclining chairs that is self storable in the chair in a pleasing and simple manner.

It is another object of the present invention to provide a folding table that forms an integral part of a reclining chair, but can be selectively removed, opened and positioned to form a large, flat table surface for use therewith.

It is a still further object of the present invention to provide a combination folding table and leg rest for a reclining chair that can be used by a person seated in the chair, whether in the upright or the reclined position.

These and other and further objects of the present invention are accomplished in one embodiment wherein the usual reclining chair footrest is replaced by a base member on which is detachably positioned a folding table which is covered by a pad and decorative leg-rest which form an integral part of the chair when the table is not in use.

BRIEF DESCRIPTION OF THE DRAWINGS

These and other and further objects of the present invention will be apparent from a description of a preferred embodiment, taken in conjunction with the drawings wherein.

DETAILED DESCRIPTION OF A PREFERRED EMBODIMENT

Figure 1:
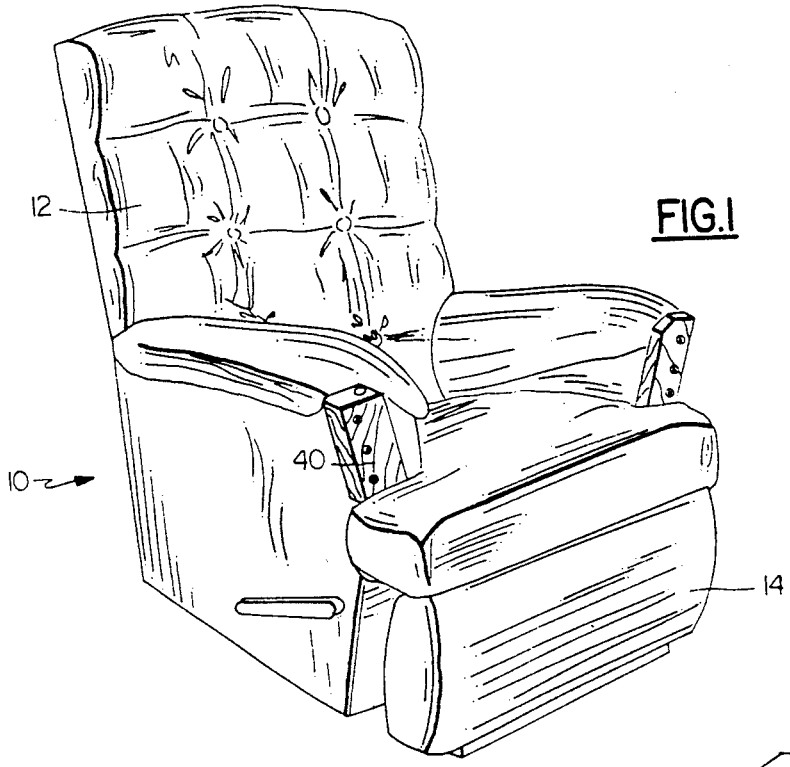
FIG. 1 is a perspective view of a chair in accordance with the present invention.
Figure 2:
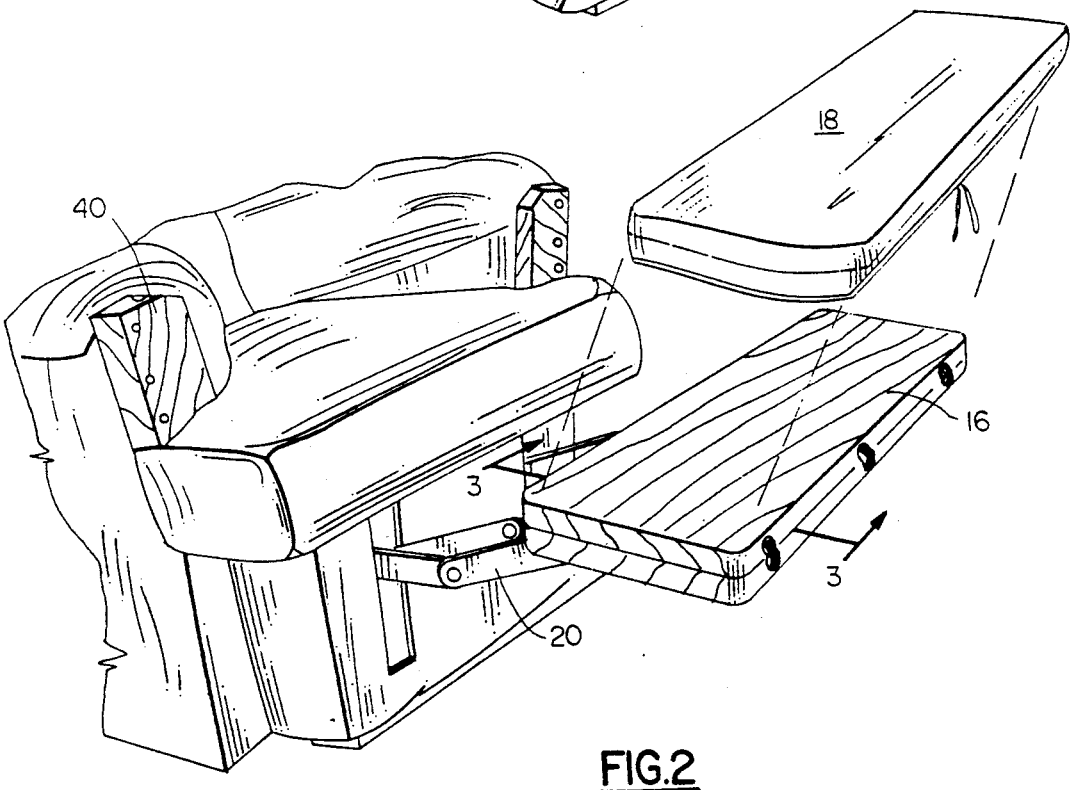
FIG. 2 is a partial perspective view of the leg-rest of the present invention with the cushioned cover shown partially removed.

Referring now to FIG. 1 the chair 10, according to the present invention has a back 12 which reclines in the usual fashion and at the same time leg-rest 14 extends outwardly and upwardly at the front of the chair to support the legs of a person reclined in the chair. This type of chair has been available for many years and in the fully upright position, looks much like any overstuffed chair. The footrest 14 of the present invention is shown in partially exploded form in FIG. 2 in which it can be seen that the overall leg-rest assembly 14 is supported on a pair of hinged scissor arms 20 attached to base member 22 and consists of a folded table assembly 16 covered by a padded cushion 18.

Figure 5:
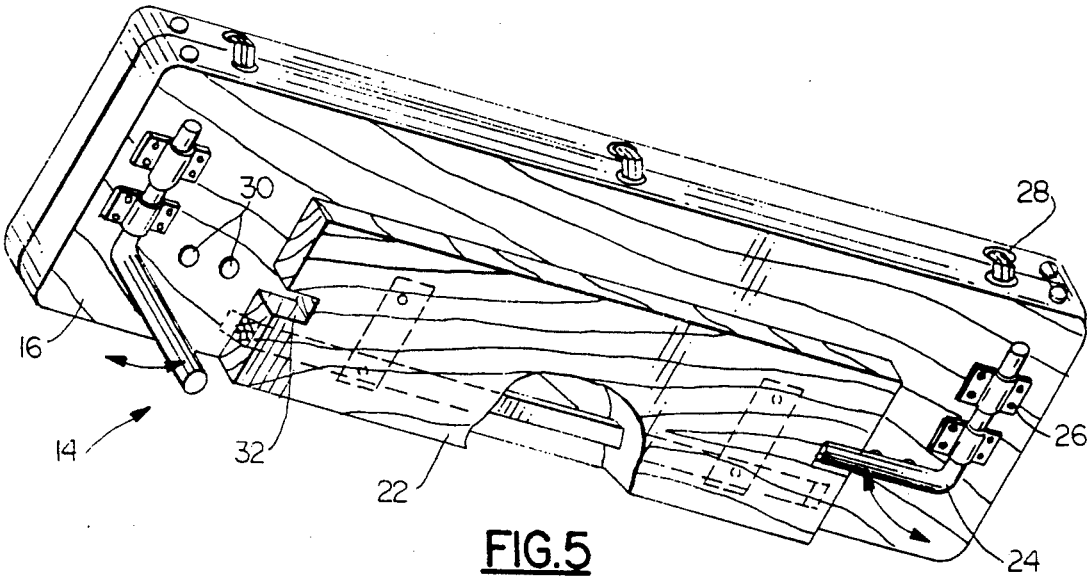
FIG. 5 is a bottom perspective view of the base member with the folded table thereon showing the folding legs.

Referring now to FIG. 5, the leg-rest assembly 14 comprises the base member 22 and the folded table 16. Table 16 is formed from two rectangular panels 17 and 19 hinged along one edge by barrel hinges 28 and folded together to form an extended leg rest platform. A pair of L-shaped mounting legs 24 hinged in loops 26 are mounted on the underside of one-half of the table 16. The legs 24 as shown are bent L-shaped rods or bars which, in the retracted position, are pivoted into notches 32 in the base member 22 and held therein by magnets 30. The folded table 16, when hooked on the foot rest base member 22 can be retracted to the position shown in FIG. 1.

Figure 7:
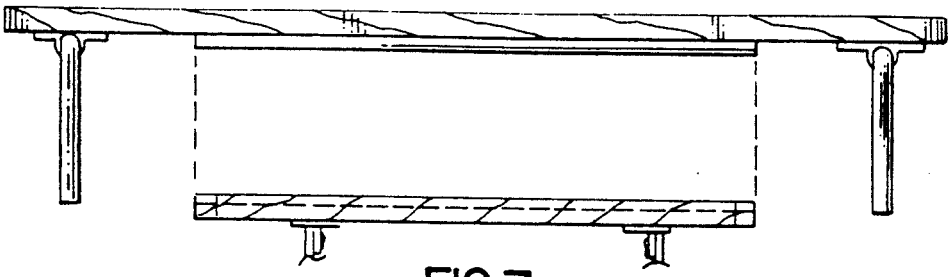
FIG. 7 is a front elevation of the table and the base.

The table assembly 16 includes two portions 17 and 19 hinged tightly together by recessed barrel hinges 28 along the long edge and has a length equal to the overall width of the chair 10. As can be seen in FIG. 5, the base member 22 has a width substantially less than the table width corresponding generally to the width between the arms of the chair which makes it easier for access to the chair when the table assembly 16 is removed and yet still will provide some leg support when in the raised position, if desired, as indicated in FIG. 7.

Figure 6:
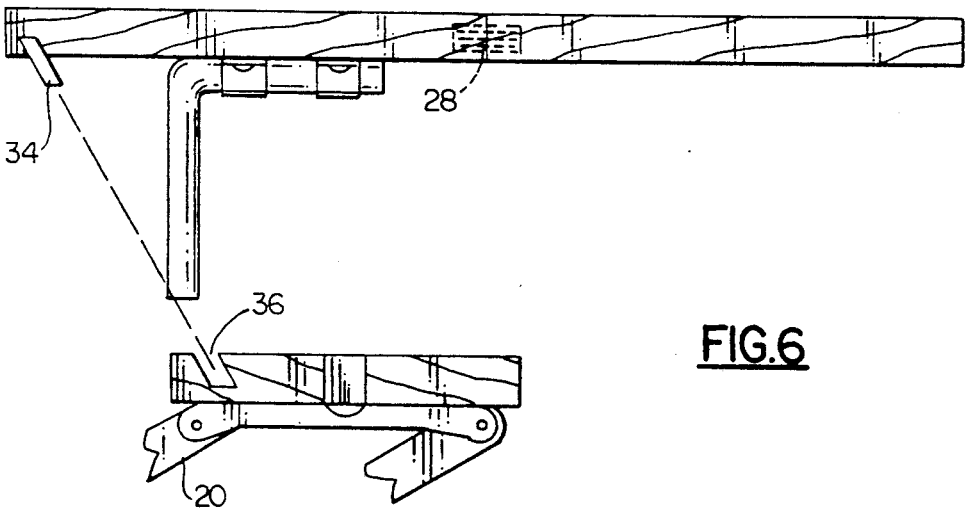
FIG. 6 is a cross-section in exploded form similar to FIG. 4.

As may be seen in FIGS. 5 and 6, the table 16 is detachably secured to the base member 22 by a cleat 34 which is adapted to be positioned in a slot 36 adjacent the upper edge of the base member 22 when in the vertical position. Slot 36 extends from end to end of the base member 22 and cleat 34 is mortised into the bottom of table 16 and has a length substantially the same as slot 36. As can be seen, the cleat 34 is angled at approximately a forty-five degree angle with the under surface of the table and the top surface of the base member 22 so as to "hang" the table assembly on the base member 22 when the leg-rest assembly is in the retracted position of FIG. 1. This angle also tends to secure the table assembly in proper position, whether or not the table is open to that of FIG. 6 or merely in the assembled horizontal position of FIG. 5.

Figure 9:
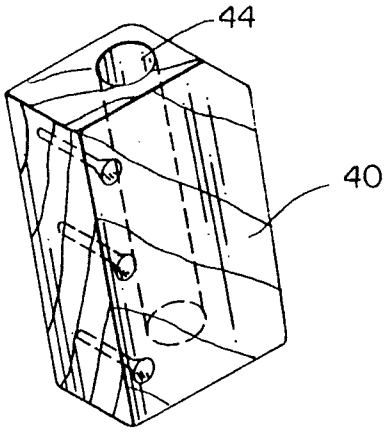
FIG. 9 is a perspective detail of the mounting receptacle for the table leg.
Figure 3:
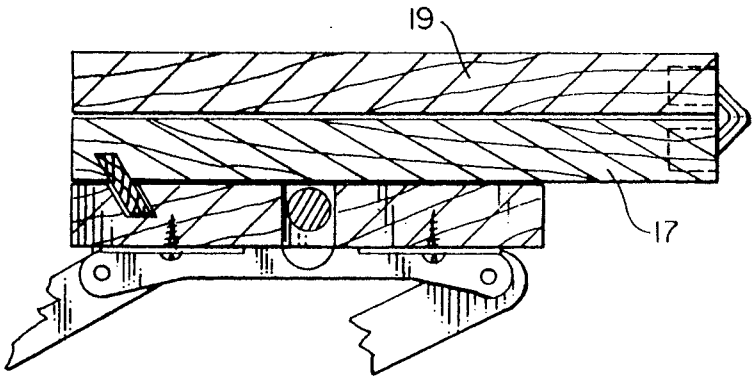
FIG. 3 is a detail view of the mounting of the folded table on the base member.
Figure 4:
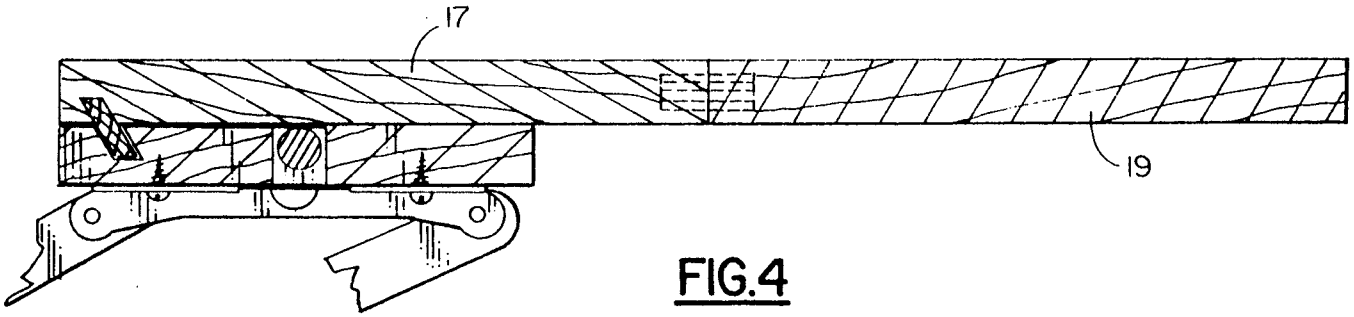
FIG. 4 is a view similar to FIG. 3 with the table in the unfolded position.
Figure 8:
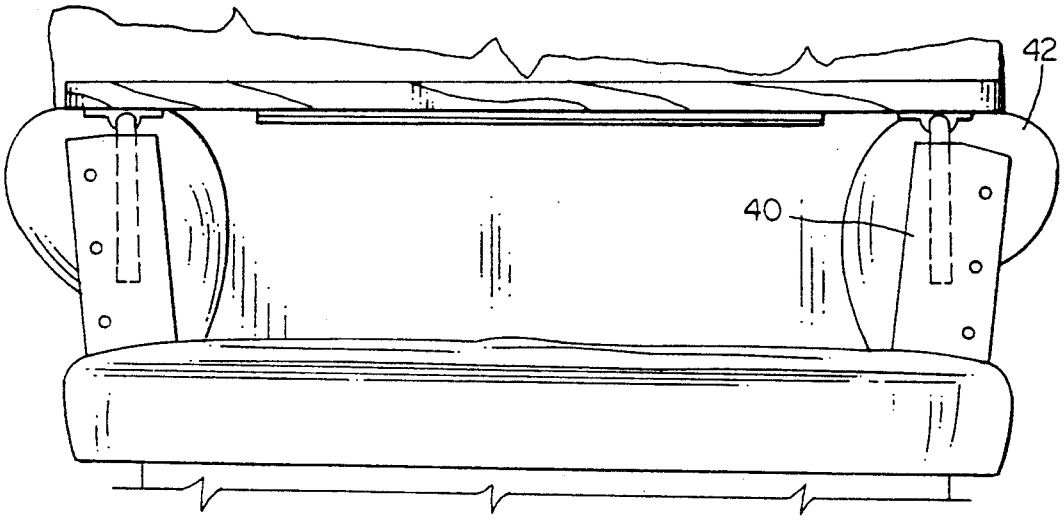
FIG. 8 is a front view of the table of the present invention mounted on the chair of FIG. 1.
Figure 10:
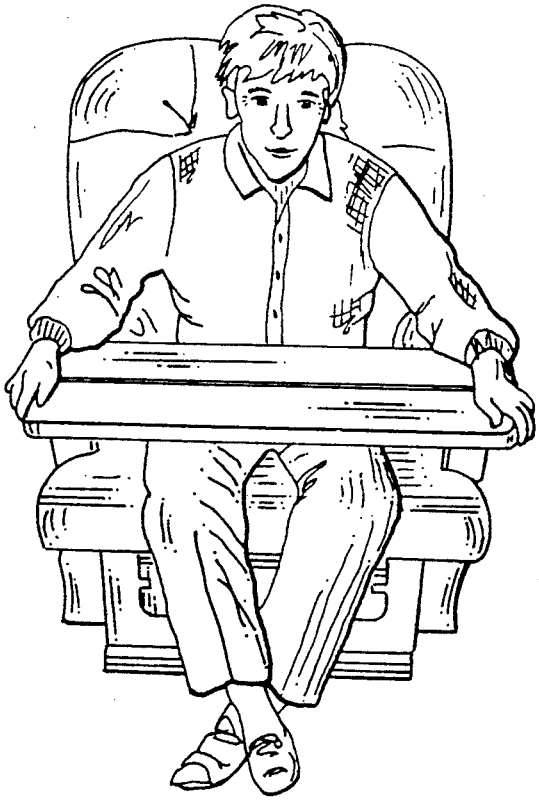
FIG. 10 is a perspective view of a person seated in a chair with the table installed.

Referring now to FIGS. 8 and 9, there is provided a pair of receptacle blocks 40 which are mounted on the front edge of the arms 42 of the chair 10. The blocks 40 have formed therein holes 44 which are generally vertical and are sized to receive therein one of the leg members 24 when the leg is pivoted to the vertical as shown in FIGS. 5 and 6, for instance. While the blocks 40 are shown in an exposed condition in the present drawings for clarity of explanation, the block normally would be covered as part of the decorative finish of the chair with only the top opening of the receptacle 44 showing for positioning of the table legs when the table is mounted in a useful position as shown in FIG. 10. The table 16, when mounted as shown in FIG. 10, generally provides a work surface at a level slightly above the top of the arms 42 at a convenient height for a person seated in the chair 10, whether in the upright or reclined position.

It will thus be seen that I have provided a combination table and leg-rest for a reclining chair in which the table can be unfolded and installed in receptacles in the arms for a large working surface. In the self-stored position on the leg-rest, covered with the padded cushion, it disappears in the overall decor of the padded and overstuffed reclining chair. The construction is simple and economical to accomplish and yet provides a very practical and rugged table and leg-rest assembly.

While I have shown the padded cover 18 as a separate piece, obviously, it could be a decorative pad affixed to the top surface, for instance, of the table assembly 16 in FIG. 5. This outer section of the table when in the unfolded position would not adversely interfere with the legs of the person sitting in the chair and would eliminate the separate cushion shown in FIG. 2.

While this invention has been explained with reference to the structure disclosed herein, it is not confined to the details set forth and this application is intended to cover any modifications and changes as may come within the scope of the following claims:

What is claimed is:

1. In a reclining chair having a leg rest movable from a substantially vertical stored position to a substantially horizontal supporting position, a combination leg rest table which comprises:

a generally rectangular base member mounted on extendable chair frame members for movement from a vertical storage position to a horizontal supporting position;

a flat generally rectangular table member detachably mounted on said base member;

a pair of retractable/extendable mounting supports fixed to one side of said table member; and a pair of receptacles fixed in a reclining chair, said receptacles being sized and spaced apart so as to receive therein said retractable/extendable mounting supports when in the extended position;

so that said table member may be selectively removed from said base member and mounted in said receptacles to form a generally horizontal table surface across the front of a reclining chair.

2. The apparatus of claim 1 including a padded cover member sized to fit about said table member when mounted on said base member to form a padded leg rest for a reclining chair.

3. The apparatus of claim 1 wherein said base member has a length approximately equal to the seat width of a reclining chair and said table member has a length equal to the overall width of a reclining chair.

4. The apparatus of claim 1 wherein said table member comprises two panels hinged together along one edge so as to form when opened out a table approximately twice as wide as the width of a leg rest on which it is to be positioned.

5. The apparatus of claim 4 wherein said table member has at least one male interlocking means extending outwardly from the surface thereof, positioned adjacent one edge of said table member and inclined toward the other edge; and said base member has formed therein at least one female interlocking means aligned with and sized to receive therein said male interlocking means;

so that when said base member is in a vertical position said table member may be "hooked" thereon for self storage with a reclining chair.

6. The apparatus of claim 5 wherein said at least one male interlocking means comprises an elongated cleat fixed to said table member and said at least one female interlocking means in said base member comprise an elongated slot formed to receive therein said cleat.

7. Apparatus according to claim 6 wherein said cleat and slot are formed at an angle of approximately 45° from the plane of said table and base member.

8. The apparatus of claim 1 wherein said table member is padded on one surface to form a comfortable leg rest when mounted on said base member.

9. The apparatus of claim 1 wherein said retractable/extendable mounting supports comprise a pair of L-shaped legs having a short and a long leg portion pivotally mounted along the short leg portion to one side of said table member for movement from a flush to an extended position.

10. The apparatus of claim 9 including magnet means positioned in the surface of said table member which carries said L-shaped legs to selectively hold said legs in the flush position.

11. The apparatus of claim 10 wherein said long legs of said L-shaped mounting supports have a length sufficient to mount said table member above the legs of a person seated in a reclining chair in the reclined position.

12. Apparatus according to claim 8 wherein said L-shaped mounting supports comprise a pair of round metal bars and said receptacles comprise a pair of cylindrical holes located in the arms of a reclining chair.

13. A reclining chair having a reclining back, a seat, a pair of arms and a leg rest comprising:

a leg rest movable from a substantially vertical stored position to a substantially horizontal supporting position;

said leg rest including a rectangular base member;

a rectangular table member detachably mounted on said base member; and a pair of mounting legs retractably mounted on said table member;

receptacle means positioned in the arms of said reclining chair to receive said pair of mounting legs; and cushion means adapted to be combined with said table member when mounted on said base member to form a comfortable leg rest;

whereby said table member may be selectively detached from said base member and said retractably mounted legs extended to fit in said receptacle means to position said table in a generally horizontal position above the arms of said reclining chair.

14. A reclining chair according to claim 13 wherein said table member is detachably mounted on said base member by a longitudinal cleat and cooperating slot formed one in said base member and one in said table member along an edge thereof so that said table member may be "hooked" onto said base member when in the vertical stored position thereof.

* * * * *